US005996678A

United States Patent [19]

Oda et al.

[11] Patent Number: 5,996,678

[45] **Date of Patent: *Dec. 7, 1999**

[54] APPARATUS FOR MAKING MOLD

[75] Inventors: Shigeo Oda, Toyokawa; Kimikazu Kaneto; Ryoji Kanayama, both of Toyohashi; Kuniyasu Mori; Kazuo Sugimoto, both of Toyokawa, all of Japan

[73] Assignee: Sintokogio, Ltd., Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/140,090

[22] Filed: Aug. 26, 1998

[30] Foreign Application Priority Data

Sep. 5, 1997 [JP] Japan ..... 9-257741

[51] Int. Cl.[6] ..... B22C 15/02; B22C 15/28

[52] U.S. Cl. ..... 164/195; 164/37; 164/38; 164/201; 164/207

[58] Field of Search ..... 164/195, 200, 164/201, 207, 37, 38

[56] References Cited

U.S. PATENT DOCUMENTS

| | | | |
|---|---|---|---|
| 5,558,148 | 9/1996 | Uzaki et al. | 164/7.1 |
| 5,660,221 | 8/1997 | Oda et al. | 164/37 |
| 5,791,396 | 8/1998 | Oda et al. | 164/37 |
| 5,794,681 | 8/1998 | Oda et al. | 164/195 |

FOREIGN PATENT DOCUMENTS

| | | | |
|---|---|---|---|
| 0748663 | 12/1996 | European Pat. Off. . | |
| 0803303 | 10/1997 | European Pat. Off. . | |
| 0811445 | 12/1997 | European Pat. Off. . | |
| 33 22 628 | 1/1985 | Germany | 164/37 |
| 53-52237 | 5/1978 | Japan | 164/195 |
| 2-251336 | 10/1990 | Japan | 164/38 |
| 3-142038 | 6/1991 | Japan . | |
| 9-1288 | 1/1997 | Japan . | |

*Primary Examiner*—J. Reed Batten, Jr.
*Attorney, Agent, or Firm*—Limbach & Limbach L.L.P.

[57] ABSTRACT

The apparatus comprises a table (5), on which a pattern plate (6) is attached, a flask (7), the bottom surface of which can be fitted to the pattern plate (6), a filling frame (30), the bottom surface of which can be fitted to the upper surface of the flask (7), and in which the highest part of its opening is smaller than the lowest part of its opening, a blow head (17), which is used for blowing in molding sand, and for squeezing the blown-in molding sand, and which is placed above the table (5), and a thin plate body (20), which can be inserted into the blown-in molding sand and which is placed around a sand holder (12) that is a part of the blow head (17), in which the highest part of the opening of the filling frame (30) has such a size that the outer surface of the thin plate body (20) can contact the inner surface of the highest part of the filling frame (30), and in which the size and shape of the lowest part of the opening of the filling frame (30) are the same as those of the opening of the flask (7).

3 Claims, 2 Drawing Sheets

APPARATUS FOR MAKING MOLD

FIELD OF INVENTION

This invention relates to an apparatus that is used for making a mold by supplying molding sand, by using a blow head, to a space defined by the blow head, a pattern plate, a flask, a filling frame, and a thin plate body, pre-compacting the supplied molding sand near the inner surface of the flask by the thin plate body, and then squeezing all the molding sand in that space by using the blow head and the thin plate body.

PRIOR ART

Japanese Patent Publication-A No. Hei 9-1288, which was assigned to the assignee of this invention, discloses an apparatus for making a mold. In using this apparatus, molding sand is usually supplied to a space inside a flask and inside a filling frame by the sand falling due to its own gravity. (However, that patent publication does not disclose the method for supplying the sand.) Therefore, the molding sand occasionally spills from the flask or the filling frame. This may require another apparatus to recover the spilled sand. Further, when molding sand is supplied by the sand falling due to its own gravity, it is not uniformly supplied to the flask, and is rather lopsided. In this case, in compacting the molding sand after the molding sand has been pre-compacted, an undesirable phenomenon, which is called "Katsugi," occurs in the part that has the greater quantity of sand. That is, the sand in the part where there is a lot of sand is first compressed, and when the sand in that part has been satisfactorily squeezed, the sand in the part where there is less sand remains to be, but can no longer be, squeezed. As a result, no uniform squeezing of the sand can be carried out.

This invention was conceived in view of these problems. It aims to provide an apparatus that is used for making a mold by supplying molding sand, by using a blow head, to a space defined by the blow head, a pattern plate, a flask, a filling frame, and a thin plate body, pre-compacting the supplied sand near the inner surface of the flask by using the thin plate body, and then squeezing all the molding sand in that space by using the blow head and the thin plate body. By this invention the molding sand is not lopsidedly supplied, no Katsugi occurs while the molding sand is squeezed, or no molding sand spills from the flask or the filling frame.

SUMMARY OF THE INVENTION

Figure 1:
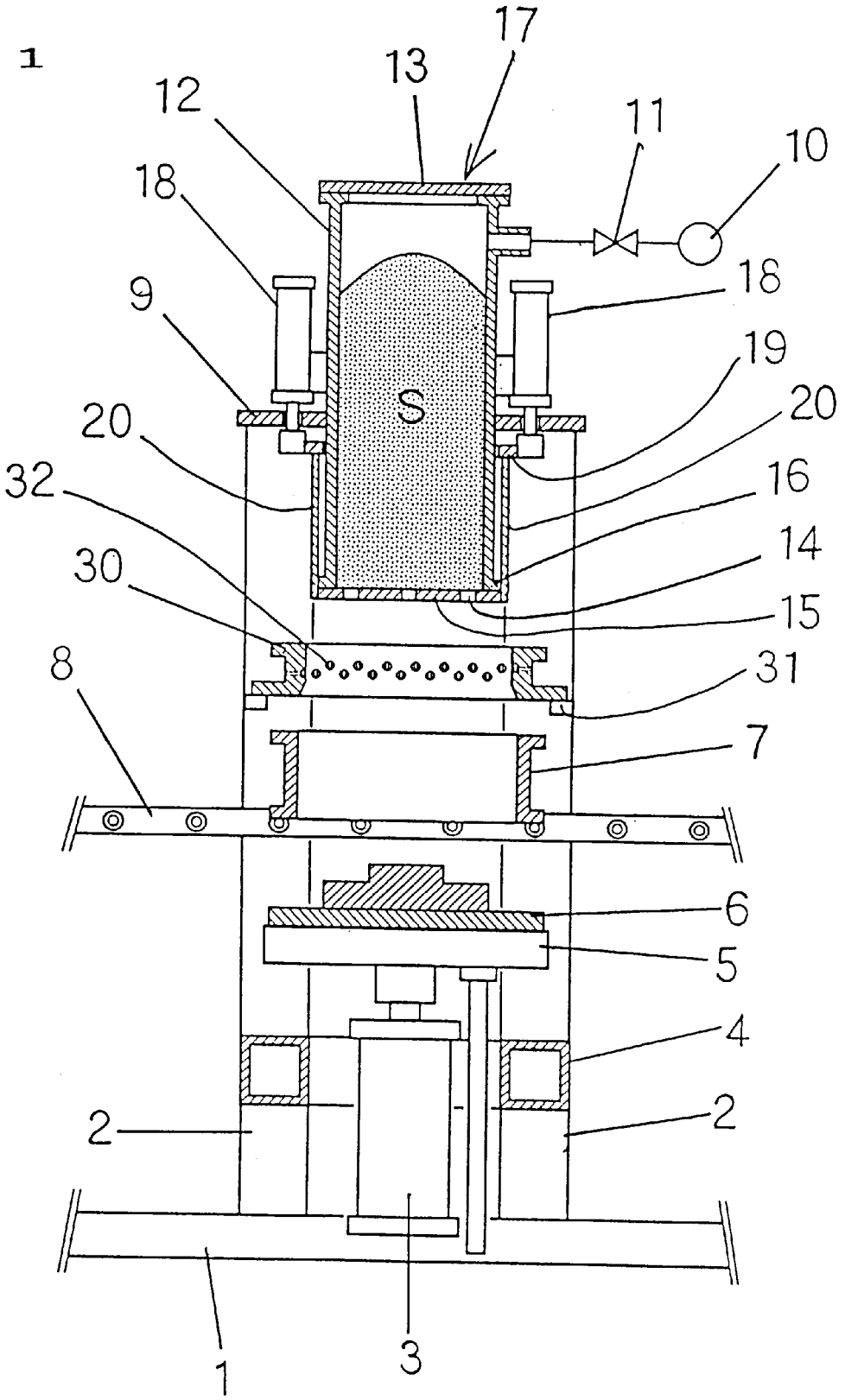
FIG. 1 is an elevational view in vertical section of an embodiment of this invention.

In this invention, provided is an apparatus for making a mold, comprising:

a table (5) that can be lifted up or moved down, on which a pattern plate (6) is attached, a flask (7) that can be moved, the bottom surface of which can be fitted to the pattern plate (6), a filling frame (30) that can be moved, the bottom surface of which can be fitted to the upper surface of the flask (7), and in which the highest part of its opening is smaller than the lowest part of its opening, a blow head (17) having at its bottom a blowing plate (15) having openings (14), which is placed above the table (5), and a thin plate body (20) that is placed around a sand holder (12) that constitutes a part of the blow head (17), the thin plate body (20) being able to be lifted up or moved down tightly against the outer surface of the blowing plate (15), and being able to be inserted into the blown-in molding sand, in which the highest part of the opening of the filling frame (30) has such a size that the outer surface of the thin plate body (20) can contact the inner surface of the highest part of the filling frame (30), and in which the size and shape of the lowest part of the opening of the filling frame (30) are substantially the same as those of the opening of the flask (7), and in which the blow head (17) is used for blowing molding sand into a space defined by the pattern plate (6), the flask (7), the filling frame (30), the blowing plate (15), and the thin plate body (20), and for squeezing the blown-in molding sand.

In a preferred embodiment, the apparatus further comprises a roller conveyer (8) for conveying the flask (7), the roller conveyer (8) being placed between the flask (7) and the table (5).

In another preferred embodiment, the blowing plate (15) is fixed to a flange (16) that is placed at the lower periphery of the body of the sand holder (12).

The above-mentioned apparatuses may also comprise another constituent part(s).

This invention also includes an apparatus comprising all the constituents of the above-preferred embodiments, and any other optional constituent part(s).

DETAILED DESCRIPTION OF THE PREFERRED EMBODIMENT

The preferred embodiment of this invention will now be explained by reference to the accompanying drawings.

FIG. 1 shows an embodiment of the apparatus of this invention. As in FIG. 1, four supports 2, 2, 2, 2 (although only two supports 2, 2 are shown) are built into a base 1, and their upper ends are fixed to a ceiling frame 9. Between the four supports 2, 2, 2, 2, that is, at the center of the base 1, an upwardly-facing cylinder 3, such as an oil cylinder, is fixed in the base 1. The cylinder 3 is supported by the four supports 2, 2, 2, 2 through four frames, two of which frames are each fitted into two other frames 4, 4, each of which is fixed to the two supports 2, 2 near their lower ends. A table 5 acts as a part of a lifter, and is secured to the top of the piston rod of the upwardly-facing cylinder 3. The table 5 can be lifted up or moved down through the operation of the cylinder 3. A pattern plate 6, on which a pattern is attached, is fixed on the upper surface of the table 5. Near the middle of the four supports 2, 2, 2, 2, in the lengthwise direction, and above the table 5, there is a flask 7. As in FIG. 1, the flask 7 is supported by a roller conveyer 8, which is placed between the flask 7 and the table 5. The roller conveyer 8 extends in the right and left directions in FIG. 1, and conveys the flask 7. The flask 7 can be moved. That is, it is transported by the conveyer 8, and can be lifted up and moved down as the table 5 is lifted up and moved down.

There is a filling frame 30 above the flask 7. The bottom surface of the filling frame 30 can be fitted to the upper surface of the flask 7. The size of the highest part of the opening of the filling frame 30 is smaller than that of the lowest part of the opening of it. The size of the highest part of the opening of it is such that the outer surface of a thin plate body 20 (which will be explained below) contacts the inner surface of the filling frame 30 at the highest part of the opening. The size and shape of the lowest part of the opening of the filling frame 30 are substantially the same as those of the opening of the flask 7. The filling frame 30 has numerous vent holes 32, 32, into which vent plugs are fitted, to vent compressed air. The filling frame 30 is put on support frames 31, 31, 31, 31, each of which is fixed to each of the supports 2, 2, 2, 2. There may be two support frames, which are parallel to each other, and each of which is made to combine, or is fixed to, two supports 2, 2. The filling frame 30 can be moved. That is, it can be lifted up and moved down as the table 5 is lifted up and moved down.

In the embodiment shown in FIG. 1, in the lower part (about the lowest ⅓) of the filling frame 30, the opening is tapered, and in the upper part (about the highest ⅔) of it, the opening has the same size. However, the opening of the filling frame 30 may be tapered from the bottom to the top.

The pattern plate 6, the flask 7, the filling frame 30, a blowing plate 15 of a blow head 17 (which will be explained below), and a thin plate body 20 (which will be explained below), together define a space. The space is filled with molding sand S.

A sand holder 12, into which the molding sand S is introduced, is supported by the ceiling frame 9. The sand holder is constituted of a body, a lid 13, and a blowing plate 15. The upper part of the sand holder 12 communicates with a compressed air source 10 through a valve 11. A lid 13, which can be opened and closed, is joined to the top of the body of the sand holder 12. A blowing plate 15, which forms the bottom of the sand holder 12, has numerous openings 14, 14. Thus, the openings 14, 14 are positioned at the bottom of the sand holder 12. It is preferable that they be uniformly distributed. Through the openings 14, 14, the molding sand S is blown into the space mentioned above. There is a flange 16 at the bottom periphery of the body of the sand holder 12. The blowing plate 15 is fixed to the flange 16. The sand holder 12 and these constituents around it constitute a blow head 17, which also acts as a squeeze.

The shape of the sand holder 12 is not limited. Examples of the shape of the body of the sand holder 12 include a cylindrical shape and a rectangular shape, although it is generally cylindrical. As shown in FIG. 1, the shape and size of the outline of the flange 16 are generally the same as those of the blowing plate 15. However, in its outline, the flange 16 may have a shape different from, or a size smaller than, that of the blowing plate 15.

One pair of cylinders 18, 18 are fitted to the outside of the sand holder 12. The cylinders 18, 18 face downward. An attachment 19, which combines a thin plate body (which will be explained below) with the cylinder 18, is fixed to the side of a piston rod of each of the cylinders 18, 18. The attachment 19 is set so that it can be lifted up or moved down tightly along the outer surface of the sand holder 12.

A thin plate body 20 is hung from the attachment 19. The inner surface of the thin plate body 20 contacts the outer surface of the blowing plate 15. As shown in FIG. 1, since the outline of the flange 16 is the same as that of the blowing plate 15, the inner surface of the thin plate body 20 also contacts the outer surface of the flange 16. That is, as shown in FIG. 1, the thin plate body 20 can be lifted up or moved down tightly against the blowing plate 15, and against the flange 16. The thin plate body 20 has such a shape and size that its outside shape and size are almost the same as or slightly smaller than the shape and size of the highest part of the opening of the filling frame 30. Thus, the thin plate body 20 can be inserted into the molding sand S in the flask 7 through the filling frame 30. The thin plate body 20 may be endless or divided into parts separated in cross section. It may be constituted by, e.g., four plates, to give an outline of a rectangular or square form. Each of the four plates may have a comb-like shape. Alternatively, the thin plate body 20 may be constituted by one thin plate, all corners of which may be rounded in cross section. In this case, the thin plate body 20 can be made by bending the thin plate to give four rounded corners.

Function

The apparatus of this invention, shown in FIG. 1, in which the molding sand S has been supplied into the sand holder 12, is driven as follows:

The upwardly-facing cylinder 3 is driven so that the pattern plate 6, together with the table 5, rises. After the pattern plate 6 is fit to the bottom surface of the frame 7, the frame 7 also rises. After the upper surface of the frame 7 is fit to the bottom surface of the filling frame 30, the filling frame 30 also rises. When the upper part of the space that is defined by the pattern plate 6, the flask 7, and the filling frame 30, is closed by the blowing plate 15 and the thin plate body 20 to form a sealed space, the upwardly-facing cylinder 3 stops rising.

Next, the valve 11 is opened to introduce compressed air into the sand holder 12 of the blow head 17. Thus, through the openings 14, 14 of the blowing plate 15, the molding sand S is blown into the above-mentioned sealed space together with the compressed air, so that the space is filled with the molding sand S. Since the molding sand S is supplied to the sealed space together with the compressed air, it does not spill from the flask 7 or the filling frame 30, and its density is uniform throughout the space. Further, since the top of the opening of the filling frame 30 is sealed with the blowing plate 15 and the thin plate body 20, the molding sand S, together with the compressed air, does not gush from the top of the opening of the filling frame 30, and the compressed air is vented from many vent holes 32, 32.

Figure 2:
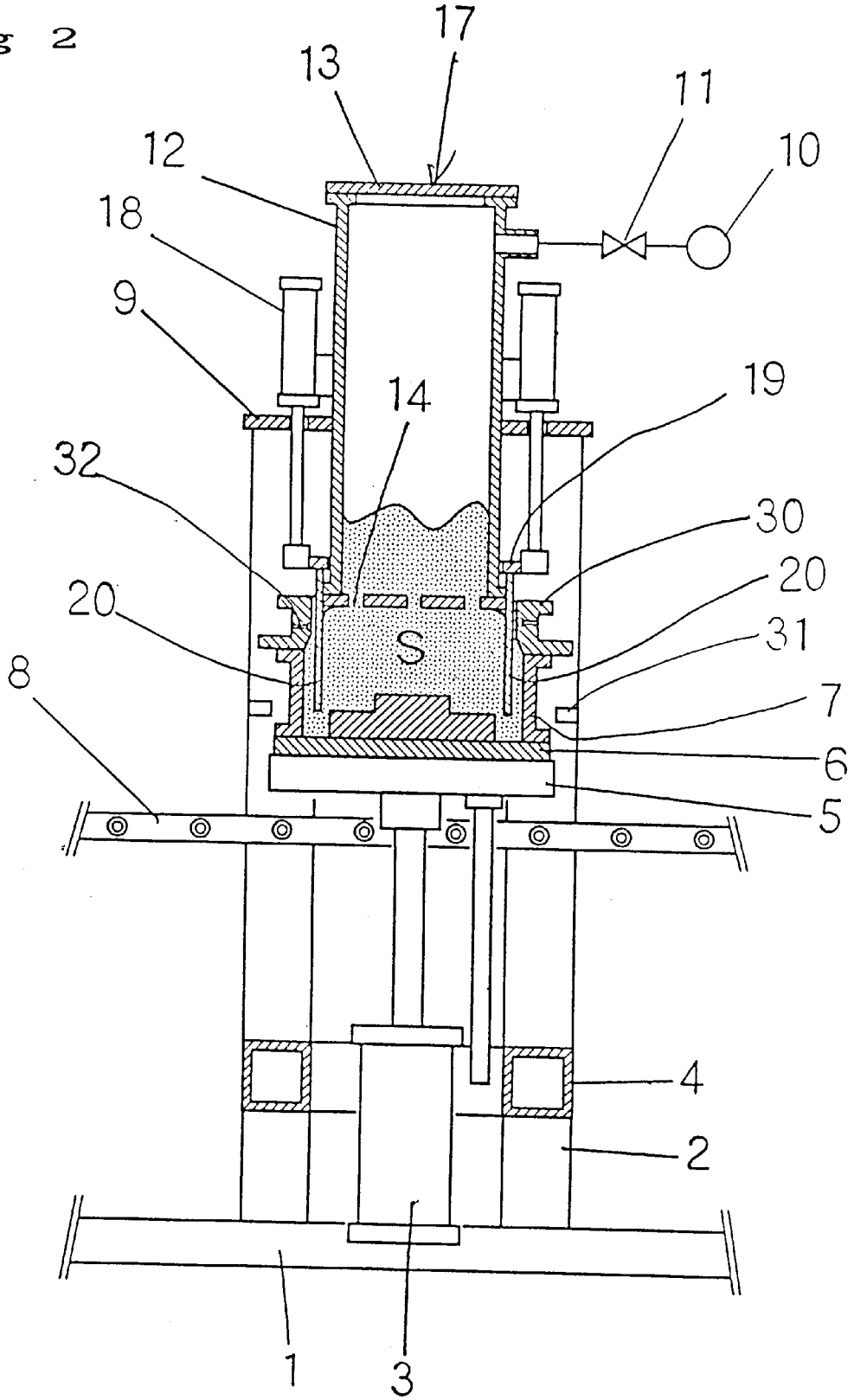
FIG. 2 is an elevational view in vertical section of the same embodiment of this invention, by which the pre-compaction condition of the molding sand is shown.

Then, as shown in FIG. 2, the cylinders 18, 18 are driven, so that the thin plate body 20 falls (i.e., it is introduced into the molding sand S) to pre-compact the molding sand S near the inner surface of the flask 7. The thin plate body 20 falls while contacting the inner surface of the filling frame 30 at the highest part of it, while tightly contacting the outer surfaces of the blowing plate 15 and the flange 16. In the flask 7 the thin plate body 20 is spaced slightly apart from its inner surface. Thus, the molding sand S that is near the inner surface of the flask 7 is effectively pre-compacted.

Then, the cylinders 18, 18 are driven in a reverse direction, so that the thin plate body 20 is pulled out from the molding sand S. Thus, the pre-compaction of the molding sand S is completed. The cylinders 18, 18 are driven until the lower surface of the thin plate body 20 reaches the same level as the lower surface of the blowing plate 15.

The upwardly-facing cylinder 3 is driven further upward to lift up the table 5, the flask 7, and the filling frame 30. Thus, all the molding sand S is squeezed (or compressed or pressed) by the blow head 17, which also acts as a squeeze, and the thin plate body 20. In this case, the upwardly-facing cylinder 3 is driven until the lower surface of the blow head 17 (specifically, the lower surface of the blowing plate 15) and the lower surface of the thin plate body 20 reach the level of the lower surface of the filling frame 30. Through these steps, a sand mold is molded.

The upwardly-facing cylinder 3 is driven in a reverse direction to lower the table 5, the pattern plate 6, the flask 7, and the filling frame 30, so that the blow head 17, which is also a squeeze, is pulled out from the filling frame 30. The cylinder 3 is driven further to lower the table 5, the pattern plate 6, the flask 7, and the filling frame 30. Thus, they return to their original positions. As a result, the pattern plate 6 is drawn down from the molded sand mold.

After molding the sand mold, the flask 7 is conveyed by the roller conveyer 8. Then, another empty flask is conveyed until it reaches a predetermined position under the filling frame 30. Then the molding sand S is again supplied to the sand holder 12 of the blow head 17, so that the condition as shown in FIG. 1 is again obtained. Then, the operations discussed above are repeated.

In the above embodiment, the flask 7 is conveyed, that is, carried in and carried away, by the roller conveyer 8. However, instead of using the roller conveyer 8, four table frames may be made, which are fixed to respective supports 2, 2, 2, 2. The flask 7 may be manually put on the table frames. Or, two table frames may be made, which are parallel, and each of which frames is fixed to two supports 2, 2. Alternatively, the flask 7 may be manually put on the pattern plate 6.

Effect of Invention

The apparatus of this invention is constituted as above. Therefore, the molding sand does not spill from the flask or the filling frame when it is supplied. Also, the molding sand is supplied so that its density is uniform throughout the space into which it is supplied. Further, no Katsugi occurs when the molding sand is squeezed. Furthermore, when the molding sand is blown into that space, none of it gushes from the filling frame.

The embodiments described above are only exemplary, and this invention is not limited to them. An artisan can readily conceive their modifications, which are also included within the scope of this invention. This invention is limited only by the following claims.

We claim:

1. An apparatus for making a mold, comprising:

a table (5) that can be lifted up or moved down, on which a pattern plate (6) is attached, a flask (7) that can be moved, the bottom surface of which can be fitted to the pattern plate (6), a filling frame (30) that can be moved, the bottom surface of which can be fitted to the upper surface of the flask (7), and in which the highest part of its opening is smaller than the lowest part of its opening, a blow head (17) having at its bottom a blowing plate (15) having openings (14), which is placed above the table (5), and a thin plate body (20) that is placed around a sand holder (12) that constitutes a part of the blow head (17), the thin plate body (20) being able to be lifted up or moved down tightly against the outer surface of the blowing plate (15), and being able to be inserted into blown-in molding sand, in which the highest part of the opening of the filling frame (30) has such a size that the outer surface of the thin plate body (20) can contact the inner surface of the highest part of the filling frame (30), and in which the size and shape of the lowest part of the opening of the filling frame (30) are substantially the same as those of the opening of the flask (7), and in which the blow head (17) is used for blowing molding sand into a space defined by the pattern plate (6), the flask (7), the filling frame (30), the blowing plate (15), and the thin plate body (20), and for squeezing the blown-in molding sand.

2. The apparatus according to claim 1, which further comprises a roller conveyer (8) for conveying the flask (7), the roller conveyer (8) being placed between the flask (7) and the table (5).

3. The apparatus according to claim 1, in which the blowing plate (15) is fixed to a flange (16) that is placed at the lower periphery of the body of the sand holder (12).

* * * * *